US008926716B2

(12) United States Patent
Ansell et al.

(10) Patent No.: US 8,926,716 B2
(45) Date of Patent: Jan. 6, 2015

(54) METHOD OF FORMULATING A FUEL COMPOSITION

(75) Inventors: Claire Ansell, Chester (GB); Richard Hugh Clark, Chester (GB); Robert Wilfred Matthews Wardle, Chester (GB); Sze Hsuean Karen Lee, Tokyo (JP)

(73) Assignee: Shell Oil Company, Houston, TX (US)

( * ) Notice: Subject to any disclaimer, the term of this patent is extended or adjusted under 35 U.S.C. 154(b) by 1153 days.

(21) Appl. No.: 11/874,782

(22) Filed: Oct. 18, 2007

(65) Prior Publication Data

US 2008/0104883 A1 May 8, 2008

(30) Foreign Application Priority Data

Oct. 20, 2006 (EP) ..... 06255404

(51) Int. Cl.

| | |
|---|---|
| ***C10L 1/10*** | (2006.01) |
| ***C10L 1/24*** | (2006.01) |
| ***C10L 1/18*** | (2006.01) |
| ***C10L 1/16*** | (2006.01) |
| ***C10L 1/04*** | (2006.01) |
| ***C10L 1/08*** | (2006.01) |
| ***C10L 1/14*** | (2006.01) |
| ***C10L 10/00*** | (2006.01) |

(52) U.S. Cl.

CPC ..... *C10L 1/1616* (2013.01); *C10L 1/04* (2013.01); *C10L 1/08* (2013.01); *C10L 1/14* (2013.01); *C10L 10/00* (2013.01); *C10L 1/1608* (2013.01); *C10L 1/2437* (2013.01)

USPC ..... 44/300; 44/370; 44/385

(58) Field of Classification Search

CPC ..... C10L 1/1616; C10L 1/04; C10L 1/08; C10L 1/14; C10L 1/1608; C10L 1/2437; C10L 10/00

USPC ..... 44/300, 370, 385, 398

See application file for complete search history.

(56) References Cited

U.S. PATENT DOCUMENTS

| | | | | |
|---|---|---|---|---|
| 4,125,566 | A | 11/1978 | Trin et al. | 260/676 R |
| 4,478,955 | A | 10/1984 | Pesa et al. | 518/713 |
| 4,816,037 | A | 3/1989 | Horodysky et al. | 44/53 |
| 4,830,636 | A | 5/1989 | Horodysky | 44/70 |
| 4,867,752 | A | 9/1989 | Braid et al. | 44/7 |
| 5,344,468 | A * | 9/1994 | Hanlon et al. | 44/379 |
| 5,490,864 | A | 2/1996 | Herbstman et al. | 44/379 |
| 6,204,426 | B1 | 3/2001 | Miller et al. | 585/739 |
| 7,189,269 | B2 * | 3/2007 | Clark et al. | 44/388 |
| 2004/0107635 | A1 * | 6/2004 | Henry, Jr. | 44/370 |
| 2004/0118033 | A1 * | 6/2004 | Wilkes et al. | 44/385 |
| 2004/0128905 | A1 * | 7/2004 | Clark et al. | 44/398 |
| 2005/0039384 | A1 * | 2/2005 | Gormley | 44/397 |
| 2005/0183325 | A1 | 8/2005 | Sutkowski | 44/418 |
| 2006/0156620 | A1 | 7/2006 | Clayton et al. | 44/457 |
| 2007/0220803 | A1 * | 9/2007 | Henry, Jr. | 44/370 |

FOREIGN PATENT DOCUMENTS

| | | | |
|---|---|---|---|
| EP | 147873 | 3/1988 | C07C 1/04 |
| EP | 583836 | 2/1997 | C10G 65/12 |
| EP | 1101813 | 5/2001 | C10G 47/14 |
| EP | 1408101 | 4/2004 | C10L 1/18 |
| GB | 2077289 | 12/1981 | C07C 1/04 |
| WO | WO95/33805 | 12/1995 | |
| WO | WO97/14768 | 4/1997 | |
| WO | WO97/14769 | 4/1997 | |
| WO | WO94/17160 | 8/1997 | |
| WO | WO98/01516 | 1/1998 | |
| WO | WO00/11116 | 3/2000 | |
| WO | WO00/11117 | 3/2000 | |
| WO | WO00/20534 | 4/2000 | |
| WO | WO00/20535 | 4/2000 | |
| WO | WO01/83406 | 11/2001 | |
| WO | WO01/83641 | 11/2001 | |
| WO | WO01/83647 | 11/2001 | |
| WO | WO01/83648 | 11/2001 | |
| WO | WO01/88064 | 11/2001 | C10L 1/00 |
| WO | WO03004588 | 1/2003 | |

OTHER PUBLICATIONS

The Shell Middle Distillate Synthesis Process, paper delivered at the 5th Synfuels Worldwide Symposium, Washington DC, Nov. 1985.

The Shell Middle Distillate Synthesis Process Nov. 1989 from Shell International Petroleum Company Ltd, London, UK.

The Lubricity of Diesel Fuels, Danping Wei and H.A. Spikes, Wear, III (1986), 217-235.

U.S. Appl. No. 11/874,771, filed Oct. 18, 2007, Ansell et al.

* cited by examiner

*Primary Examiner* — James Goloboy
*Assistant Examiner* — Latosha Hines

(57) ABSTRACT

In a fuel composition containing a static dissipator additive, a Fischer-Tropsch derived fuel component is blended for the purpose of increasing the electrical conductivity of the composition and/or for reducing the concentration of the static dissipator additive in the composition. The fuel composition is preferably an automotive diesel fuel composition.

7 Claims, No Drawings

METHOD OF FORMULATING A FUEL COMPOSITION

FIELD OF THE INVENTION

The present invention relates to a certain method of formulating a fuel composition.

BACKGROUND OF THE INVENTION

The transport of a fuel often involves pumping, which can generate static electricity in the fuel and hence electric fields in its vapour phase. This is hazardous since subsequent spark discharges can then cause explosion and fire.

In order to reduce such hazards, static dissipator additives are often included in fuel compositions. These act to increase the electrical conductivity of the fuel, allowing charge generated during pumping to leak away more readily.

Fuels with an inherently lower conductivity generally require higher levels of static dissipator additives, which can be undesirable for cost reasons. Low conductivity fuels include in particular those which are low in polar fuel components such as aromatics and sulphur- or nitrogen-containing compounds. As pressure to reduce sulphur levels in fuels, in particular automotive fuels, increases, this in turn increases the problems associated with poor conductivity.

It is an aim of the present invention to provide fuel compositions, and/or components for use in such compositions, which can overcome or at least mitigate the above described problems.

SUMMARY OF THE INVENTION

Accordingly, a method of formulating a fuel composition is provided, the method comprising (i) blending together a base fuel and a static dissipator additive, (ii) measuring the electrical conductivity of the resultant blend and (iii) incorporating a Fischer-Tropsch derived fuel component in an amount effective to increase the electrical conductivity of the blend.

Another method for formulating a fuel composition is provided, in order to achieve a target minimum electrical conductivity X, which method comprises adding to a base fuel an amount x of a static dissipator additive and an amount y of a Fischer-Tropsch derived fuel component having an electrical conductivity lower than that of the base fuel and static dissipator additive together, wherein:

a) the amount x is lower than the amount which would need to be added to the composition in order to achieve the target conductivity X if linear blending rules applied;

and/or b) the amount y is higher than the amount which, if linear blending rules applied, could be added to the fuel composition whilst still achieving the target conductivity X.

DETAILED DESCRIPTION OF THE INVENTION

Fischer-Tropsch derived fuel components, as defined in more detail below, have relatively low electrical conductivity. This is because they tend to be low in polar species such as sulphur-, nitrogen- and oxygen-containing compounds, and also in aromatic fuel components. Thus, one would naturally expect a fuel composition containing a Fischer-Tropsch derived fuel component to have an overall lower conductivity than a similar composition without the Fischer-Tropsch fuel. It has now surprisingly been found, however, that in certain cases the addition of a Fischer-Tropsch derived component to a fuel composition containing a static dissipator additive can actually increase the electrical conductivity of the composition. In other cases, which again is unexpected, the addition of a Fischer-Tropsch derived component can result in less of a reduction in conductivity than would be predicted on the basis of linear blending rules. It is possible that a Fischer-Tropsch derived fuel component can interact synergistically with a static dissipator additive, to result in an overall conductivity higher than that which would have been expected from the effects of the two components individually.

Following conventional principles, it would be expected that the conductivity of a composition containing a Fischer-Tropsch derived fuel component would vary linearly with Fischer-Tropsch fuel concentration. In other words, the addition of a Fischer-Tropsch derived component to a fuel composition would be expected, if the Fischer-Tropsch fuel had a lower conductivity than the rest of the composition, as is typically the case, to reduce the conductivity of the composition to an extent directly proportional to the amount of the Fischer-Tropsch fuel added. Certainly no increase in conductivity would be expected no matter how much Fischer-Tropsch fuel were added to the composition.

It has now been discovered, however, that a Fischer-Tropsch derived fuel component can produce a non-linear change in conductivity when used in fuel compositions containing static dissipator additives. Moreover, it has been found that at certain optimum concentrations, a Fischer-Tropsch derived fuel can increase the conductivity of a fuel composition to a level which is often well above that of either the composition or the Fischer-Tropsch fuel alone.

Based on these discoveries, the present invention is able to provide a more optimised method for modifying the electrical conductivity of a fuel composition.

One embodiment of the present invention provides the use of a Fischer-Tropsch derived fuel component, in a fuel composition containing a static dissipator additive, for the purpose of reducing the concentration of the static dissipator additive in the composition.

Because the static dissipator additive and the Fischer-Tropsch derived fuel can act together to improve electrical conductivity, incorporation of the Fischer-Tropsch fuel potentially enables lower levels of the static dissipator additive to be used in order to achieve a desired target conductivity in the overall composition.

A certain level of electrical conductivity may for instance be desirable in order for the fuel composition to meet current fuel specifications, and/or to comply with health and safety regulations, and/or to satisfy consumer demand. According to the present invention, such standards may still be achievable even with reduced levels of static dissipator additive, due to the presence of the Fischer-Tropsch derived fuel component.

In the context of the above embodiment, the term "reducing" embraces any degree of reduction, although preferably not reduction to zero. The reduction may for instance be 1% or more of the original concentration of static dissipator additive, preferably 2 or 5 or 10% or more, most preferably 15 or 20 or even 25% or more. The reduction may be as compared to the concentration of static dissipator additive which would otherwise have been incorporated into the fuel composition in order to achieve the properties and performance required and/or desired of it in the context of its intended use. This may for instance be the concentration of static dissipator additive which was present in the fuel composition prior to the realisation that a Fischer-Tropsch derived fuel component could be used in the way provided by the present invention, and/or which was present in an otherwise analogous fuel composition intended (e.g. marketed) for use in an analogous context, prior to adding a Fischer-Tropsch derived fuel component to it in accordance with the present invention.

The reduction in concentration of static dissipator additive may be as compared to the concentration of static dissipator additive which would be predicted to be necessary to achieve a desired target conductivity, if linear blending rules applied, as is further described below.

Preferably, the reduction in concentration of static dissipator additive is achieved with less reduction in electrical conductivity than would otherwise (i.e. in the absence of the Fischer-Tropsch fuel) be caused by the reduction in concentration of static dissipator additive. The reduction in conductivity may for instance be less than 5%, preferably less than 2 or 1%, more preferably less than 0.5 or 0.1%, of the conductivity of the fuel composition before reducing its concentration of static dissipator additive.

More preferably, the reduction in concentration of static dissipator additive is achieved without any reduction in the electrical conductivity of the fuel composition, relative to the conductivity of the composition before reducing its concentration of static dissipator additive. In some cases the conductivity of the fuel composition may be increased by carrying out the present invention, despite the reduction in concentration of static dissipator additive.

In certain cases, static dissipator additive levels in a fuel composition need to be "topped up" subsequent to its initial addition, to ensure maintenance of the desired conductivity. This can for instance be necessary after a certain period of time or after an event such as pumping or transportation of the fuel composition.

One embodiment of the present invention may therefore be carried out for the purpose of reducing the need for such subsequent additions of static dissipator additive, for instance to reduce the number of subsequent additions needed or their frequency. Ideally, as a result of carrying out the present invention, no subsequent addition of static dissipator additive is necessary. The present invention thus preferably results in a fuel composition having an electrical conductivity that does not decrease over time or on transportation of the composition, or at least decreases by no more than 10%, preferably no more than 5 or 2 or 1% of its original value, or decreases by less (over a given time period or following a given event) than it would have done had the Fischer-Tropsch derived fuel component not been added in accordance with the present invention. The relevant time period may for example be 4 weeks, suitably 6 weeks, preferably 10 or 12 weeks; in some cases it may be 6, 12, 18 or even 24 months.

Another embodiment of the present invention provides a method for formulating a fuel composition, the method comprising (i) blending together a base fuel and a static dissipator additive, optionally with other fuel components, (ii) measuring the electrical conductivity of the resultant blend and (iii) incorporating a Fischer-Tropsch derived fuel component in an amount sufficient to increase the electrical conductivity of the blend. Preferably, the static dissipator additive is included in the blend at a lower concentration than would have been necessary or desirable had the Fischer-Tropsch derived fuel component not been incorporated, as discussed above.

Preferably, the static dissipator additive is included in the blend at a lower concentration than would have been predicted to be necessary to achieve a desired target conductivity if linear blending rules applied, as discussed above.

By using the present invention, it can be possible to include in a fuel composition a higher concentration of a Fischer-Tropsch derived fuel component than would have been predicted to be possible—whilst still achieving a desired target electrical conductivity—had linear blending rules applied. It can be desirable to increase the concentration of a Fischer-Tropsch derived fuel for a number of reasons, for example to reduce emissions from a fuel-consuming system (typically an engine) running on the fuel composition, and/or to reduce the level of sulphur, aromatics or other polar components in the composition. However, it has been necessary, in the past, to balance such benefits against the generally undesirable reduction in electrical conductivity expected to result from increasing the concentration of the Fischer-Tropsch fuel. According to the present invention, such benefits can now be achieved with less, or in some cases with no, negative impact on electrical conductivity.

Thus, according to another embodiment of the present invention, there is provided the use of a Fischer-Tropsch derived fuel component, in a fuel composition containing a static dissipator additive, for the purpose of achieving a benefit (such as those described above) associated with the use of a Fischer-Tropsch derived fuel without, or with less, reduction in the electrical conductivity of the composition. The concentration of the Fischer-Tropsch component in the fuel composition may be higher than that which would be predicted to be possible, to achieve a desired target conductivity, if linear blending rules applied. The benefit is typically one which results from the inherent properties of the Fischer-Tropsch derived fuel component, for instance from its relatively low content of polar species or its relatively low density.

The present invention can therefore be used to achieve a desired target electrical conductivity at the same time as achieving a reduced concentration of static dissipator additive and/or an increased concentration of the Fischer-Tropsch derived fuel.

Yet according to another embodiment of the present invention, there is provided a method for formulating a fuel composition in order to achieve a target minimum electrical conductivity X, which method comprises adding to a base fuel an amount x of a static dissipator additive and an amount y of a Fischer-Tropsch derived fuel component having an electrical conductivity lower than that of the base fuel and static dissipator additive together, wherein:

a) the amount x is lower than the amount which would need to be added to the composition in order to achieve the target conductivity X if linear blending rules applied;

and/or b) the amount y is higher than the amount which would be possible, whilst still achieving the target conductivity X, if linear blending rules applied.

As discussed above, if linear blending rules applied then the conductivity of a fuel composition containing both a static dissipator additive and a relatively low conductivity Fischer-Tropsch derived fuel component would decrease linearly with increasing concentration of the Fischer-Tropsch fuel. If this were the case, it would then be straightforward to calculate the concentration of static dissipator additive needed, at any given concentration of the Fischer-Tropsch derived fuel, to achieve the target conductivity X; equally, it would be straightforward to calculate the maximum concentration of the Fischer-Tropsch fuel which could be included, given a certain concentration of static dissipator additive, without reducing the conductivity of the overall composition below the target X.

However, it has now been found that, in particular at lower concentrations, a Fischer-Tropsch derived fuel component can cause less of a reduction in conductivity than would be expected if linear blending rules applied. In some cases a Fischer-Tropsch derived fuel component can actually "boost" the electrical conductivity of a fuel composition above its level prior to incorporating the Fischer-Tropsch fuel; this in turn can allow a lower concentration of static dissipator additive to be used to achieve any given target X, thus reducing the overall additive levels in the composition and their associated costs.

Since it may be desirable to add a Fischer-Tropsch derived component to a fuel composition for other reasons, as described above, the ability to use a Fischer-Tropsch derived fuel for the additional purpose of increasing electrical conductivity can provide formulation advantages.

The methods of the present invention may, as mentioned above, be used for the purpose of achieving a desired target (typically minimum) electrical conductivity in the fuel composition. This target is suitably 50 pS/m or greater, preferably 100 or 150 pS/m or greater.

The fuel composition used in the present invention may be, for example, a naphtha, kerosene or diesel fuel composition. It may in particular be a middle distillate fuel composition, for example a heating oil, an industrial gas oil, an automotive diesel fuel, a distillate marine fuel or a kerosene fuel such as an aviation fuel or heating kerosene. Preferably, the fuel composition is for use in an engine such as an automotive engine or an aeroplane engine. More preferably, it is for use in an internal combustion engine; yet more preferably, it is an automotive fuel composition, still more preferably a diesel fuel composition which is suitable for use in an automotive diesel (compression ignition) engine.

The fuel composition will typically contain a major proportion of, or consist essentially or entirely of, a base fuel such as a distillate hydrocarbon base fuel. A "major proportion" means typically 80% v/v or greater, more suitably 90 or 95% v/v or greater, most preferably 98 or 99 or 99.5% v/v or greater. Such a base fuel may for example be a naphtha, kerosene or diesel fuel, preferably a kerosene or diesel fuel, more preferably a diesel fuel. In accordance with the present invention, the base fuel should be a non-Fischer-Tropsch derived fuel.

A naphtha base fuel will typically boil in the range from 25 to 175° C. A kerosene base fuel will typically boil in the range from 150 to 275° C. A diesel base fuel will typically boil in the range from 150 to 400° C.

The base fuel may in particular be a middle distillate base fuel, in particular a diesel base fuel, and in this case it may itself comprise a mixture of middle distillate fuel components (components typically produced by distillation or vacuum distillation of crude oil), or of fuel components which together form a middle distillate blend. Middle distillate fuel components or blends will typically have boiling points within the usual middle distillate range of 125 to 550° C. or 150 to 400° C.

A diesel base fuel may be an automotive gas oil (AGO). Typical diesel fuel components comprise liquid hydrocarbon middle distillate fuel oils, for instance petroleum derived gas oils. Such base fuel components may be organically or synthetically derived. They will typically have boiling points within the usual diesel range of 125 or 150 to 400 or 550° C., depending on grade and use. They will typically have densities from 0.75 to 1.0 g/cm$^3$, preferably from 0.8 to 0.9 or 0.86 g/cm$^3$, at 15° C. (IP 365) and measured cetane numbers (ASTM D613) of from 35 to 80, more preferably from 40 to 75 or 70. Their initial boiling points will suitably be in the range 150 to 230° C. and their final boiling points in the range 290 to 400° C. Their kinematic viscosity at 40° C. (ASTM D445) might suitably be from 1.5 to 4.5 mm$^2$/s.

Such fuels are generally suitable for use in a compression ignition (diesel) internal combustion engine, of either the indirect or direct injection type.

A diesel fuel composition which results from carrying out the present invention will also preferably fall within these general specifications. Suitably it will comply with applicable current standard specification(s) such as for example EN 590 (for Europe) or ASTM D975 (for the USA). By way of example, the fuel composition may have a density from 0.82 to 0.845 g/cm$^3$ at 15° C.; a $T_{95}$ boiling point (ASTM D86) of 360° C. or less; a cetane number (ASTM D613) of 51 or greater; a kinematic viscosity (ASTM D445) from 2 to 4.5 mm$^2$/s at 40° C.; a sulphur content (ASTM D2622) of 50 mg/kg or less; and/or a polycyclic aromatic hydrocarbons (PAH) content (IP 391(mod)) of less than 11%. Relevant specifications may, however, differ from country to country and from year to year and may depend on the intended use of the fuel composition.

A petroleum derived gas oil may be obtained from refining and optionally (hydro)processing a crude petroleum source. It may be a single gas oil stream obtained from such a refinery process or a blend of several gas oil fractions obtained in the refinery process via different processing routes. Examples of such gas oil fractions are straight run gas oil, vacuum gas oil, gas oil as obtained in a thermal cracking process, light and heavy cycle oils as obtained in a fluid catalytic cracking unit and gas oil as obtained from a hydrocracker unit. Optionally, a petroleum derived gas oil may comprise some petroleum derived kerosene fraction.

Such gas oils may be processed in a hydrodesulphurisation (HDS) unit so as to reduce their sulphur content to a level suitable for inclusion in an automotive fuel composition. This also tends to reduce the content of other polar species such as oxygen- or nitrogen-containing species, and leads to a reduction in electrical conductivity.

In the methods of the present invention, a base fuel may be or contain a so-called "biofuel" component such as a vegetable oil or vegetable oil derivative (e.g. a fatty acid ester, in particular a fatty acid methyl ester) or another oxygenate such as an acid, ketone or ester. Such components need not necessarily be bio-derived.

The fuel composition to which the present invention is applied will typically, prior to incorporation of the static dissipator additive and the Fischer-Tropsch derived fuel component, have a low electrical conductivity. Its conductivity may for instance be less than 100 pS/m, in cases less than 50 or 25 or 20 or even 10 pS/m (ASTM D2624). In other cases its conductivity may be 5 pS/m or lower, or 2 or 1 pS/m or lower.

Low conductivity can result from low levels of polar species such as aromatic fuel components and sulphur- or nitrogen-containing compounds. Thus, the fuel composition may, prior to carrying out the present invention, contain a low concentration of aromatic fuel components, for instance 25% w/w or less, or 20 or 10 or 5 or in cases even 1% w/w or less. It may have a low sulphur content, for example at most 1000 mg/kg. More preferably, it will have a low or ultra low sulphur content, for instance at most 500 mg/kg, preferably no more than 350 mg/kg, most preferably no more than 100 or 50 or 10 or even 5 mg/kg, of sulphur.

As described above, the processes used to remove sulphur from a fuel can also often result in a reduction in the levels of other polar materials such as nitrogen- and oxygen-containing species.

Generally speaking, a fuel composition which has been subjected to hydroprocessing (as typically manifested by a relatively low sulphur content, in particular 50 mg/kg or less) is more likely to require a static dissipator additive, and the present invention may thus be of use in treating such compositions.

A fuel composition useable in accordance with the present invention preferably contains a high level of paraffinic fuel components, for example 70% v/v or greater. Normal and iso-paraffins are preferred to cyclic paraffins.

The Fischer-Tropsch derived fuel component used in the present invention may be for example a Fischer-Tropsch derived naphtha, kerosene or gas oil, preferably a kerosene or gas oil, more preferably a gas oil.

By "Fischer-Tropsch derived" is meant that a fuel is, or derives from, a synthesis product of a Fischer-Tropsch condensation process. A Fischer-Tropsch derived fuel may also be referred to as a GTL (Gas-to-Liquid) fuel. The term "non-Fischer-Tropsch derived" may be construed accordingly.

Fischer-Tropsch derived fuels are known and in use in for instance automotive diesel fuel compositions, and are described in more detail below. They tend to have low levels of aromatic fuel components and of sulphur and other polar species, and hence low electrical conductivities.

The Fischer-Tropsch reaction converts carbon monoxide and hydrogen into longer chain, usually paraffinic, hydrocarbons:

$$n(CO+2H_2)=(—CH_2—)_n+nH_2O+\text{heat},$$

in the presence of an appropriate catalyst and typically at elevated temperatures (e.g. 125 to 300° C., preferably 175 to 250° C.) and/or pressures (e.g. 5 to 100 bar, preferably 12 to 50 bar). Hydrogen:carbon monoxide ratios other than 2:1 may be employed if desired.

The carbon monoxide and hydrogen may themselves be derived from organic or inorganic, natural or synthetic sources, typically either from natural gas or from organically derived methane. The gases which are converted into liquid fuel components using such processes can in general include natural gas (methane), LPG (e.g. propane or butane), "condensates" such as ethane, synthesis gas (CO/hydrogen) and gaseous products derived from coal, biomass and other hydrocarbons.

Gas oil, naphtha and kerosene products may be obtained directly from the Fischer-Tropsch reaction, or indirectly for instance by fractionation of Fischer-Tropsch synthesis products or from hydrotreated Fischer-Tropsch synthesis products. Hydrotreatment can involve hydrocracking to adjust the boiling range (see, e.g. GB-B-2077289 and EP-A-0147873) and/or hydroisomerisation which can improve cold flow properties by increasing the proportion of branched paraffins. EP-A-0583836 describes a two step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel. The desired gas oil fraction(s) may subsequently be isolated for instance by distillation.

Other post-synthesis treatments, such as polymerisation, alkylation, distillation, cracking-decarboxylation, isomerisation and hydroreforming, may be employed to modify the properties of Fischer-Tropsch condensation products, as described for instance in U.S. Pat. Nos. 4,125,566 and 4,478,955.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for instance in EP-A-0583836 (pages 3 and 4).

An example of a Fischer-Tropsch based process is the SMDS (Shell Middle Distillate Synthesis) described by van der Burgt et al in "The Shell Middle Distillate Synthesis Process", paper delivered at the 5th Synfuels Worldwide Symposium, Washington D.C., November 1985 (see also the November 1989 publication of the same title from Shell International Petroleum Company Ltd, London, UK). This process (also sometimes referred to as the Shell "Gas-To-Liquids" or "GTL" technology) produces middle distillate range products by conversion of a natural gas (primarily methane) derived synthesis gas into a heavy long chain hydrocarbon (paraffin) wax which can then be hydroconverted and fractionated to produce liquid transport fuels such as the gas oils useable in diesel fuel compositions. A version of the SMDS process, utilising a fixed bed reactor for the catalytic conversion step, is currently in use in Bintulu, Malaysia and its gas oil products have been blended with petroleum derived gas oils in commercially available automotive fuels.

Gas oils, naphthas and kerosenes prepared by the SMDS process are commercially available for instance from Shell companies. Further examples of Fischer-Tropsch derived gas oils are described in EP-A-0583836, EP-A-1101813, WO-A-97/14768, WO-A-97/14769, WO-A-00/20534, WO-A-00/20535, WO-A-00/11116, WO-A-00/11117, WO-A-01/83406, WO-A-01/83641, WO-A-01/83647, WO-A-01/83648 and U.S. Pat. No. 6,204,426.

By virtue of the Fischer-Tropsch process, a Fischer-Tropsch derived fuel has essentially no, or undetectable levels of, sulphur and nitrogen. Compounds containing these heteroatoms tend to act as poisons for Fischer-Tropsch catalysts and are therefore removed from the synthesis gas feed. This can in turn lead to low electrical conductivities.

Further, the Fischer-Tropsch process as usually operated produces no or virtually no aromatic components, again reducing the electrical conductivity of the resultant fuel. The aromatics content of a Fischer-Tropsch derived fuel, suitably determined by ASTM D4629, will typically be below 1% w/w, preferably below 0.5% w/w and more preferably below 0.2 or 0.1% w/w.

Generally speaking, Fischer-Tropsch derived fuels have relatively low levels of polar components, in particular polar surfactants, for instance compared to petroleum derived fuels. Such polar components may include for example oxygenates, and sulphur- and nitrogen-containing compounds. A low level of sulphur in a Fischer-Tropsch derived fuel is generally indicative of low levels of both oxygenates and nitrogen-containing compounds, since all are removed by the same treatment processes.

Where a Fischer-Tropsch derived fuel component is a naphtha fuel, it will be a liquid hydrocarbon distillate fuel with a final boiling point of typically up to 220° C. or preferably of 180° C. or less. Its initial boiling point is preferably higher than 25° C., more preferably higher than 35° C. Its components (or the majority, for instance 95% w/w or greater, thereof) are typically hydrocarbons having 5 or more carbon atoms; they are usually paraffinic.

In the context of the present invention, a Fischer-Tropsch derived naphtha fuel preferably has a density of from 0.67 to 0.73 g/cm$^3$ at 15° C. and/or a sulphur content of 5 mg/kg or less, preferably 2 mg/kg or less. It preferably contains 95% w/w or greater of iso- and normal paraffins, preferably from 20 to 98% w/w or greater of normal paraffins. It is preferably the product of a SMDS process, preferred features of which may be as described below in connection with Fischer-Tropsch derived gas oils.

A Fischer-Tropsch derived kerosene fuel is a liquid hydrocarbon middle distillate fuel with a distillation range suitably from 140 to 260° C., preferably from 145 to 255° C., more preferably from 150 to 250° C. or from 150 to 210° C. It will have a final boiling point of typically from 190 to 260° C., for instance from 190 to 210° C. for a typical "narrow-cut" kerosene fraction or from 240 to 260° C. for a typical "full-cut" fraction. Its initial boiling point is preferably from 140 to 160° C., more preferably from 145 to 160° C.

A Fischer-Tropsch derived kerosene fuel preferably has a density of from 0.730 to 0.760 g/cm$^3$ at 15° C.—for instance from 0.730 to 0.745 g/cm$^3$ for a narrow-cut fraction and from 0.735 to 0.760 g/cm$^3$ for a full-cut fraction. It preferably has a sulphur content of 5 mg/kg or less. It may have a cetane number of from 63 to 75, for example from 65 to 69 for a narrow-cut fraction or from 68 to 73 for a full-cut fraction. It is preferably the product of a SMDS process, preferred features of which may be as described below in connection with Fischer-Tropsch derived gas oils.

A Fischer-Tropsch derived gas oil should be suitable for use as a diesel fuel, ideally as an automotive diesel fuel; its components (or the majority, for instance 95% v/v or greater, thereof) should therefore have boiling points within the typical diesel fuel ("gas oil") range, i.e. from about 150 to 400° C. or from 170 to 370° C. It will suitably have a 90% v/v distillation temperature of from 300 to 370° C.

A Fischer-Tropsch derived gas oil will typically have a density from 0.76 to 0.79 g/cm$^3$ at 15° C.; a cetane number (ASTM D613) greater than 70, suitably from 74 to 85; a kinematic viscosity (ASTM D445) from 2 to 4.5, preferably from 2.5 to 4.0, more preferably from 2.9 to 3.7, mm$^2$/s at 40° C.; and a sulphur content (ASTM D2622) of 5 mg/kg or less, preferably of 2 mg/kg or less.

Preferably, a Fischer-Tropsch derived fuel component used in the present invention is a product prepared by a Fischer-Tropsch methane condensation reaction using a hydrogen/carbon monoxide ratio of less than 2.5, preferably less than 1.75, more preferably from 0.4 to 1.5, and ideally using a cobalt containing catalyst. Suitably, it will have been obtained from a hydrocracked Fischer-Tropsch synthesis product (for instance as described in GB-B-2077289 and/or EP-A-0147873), or more preferably a product from a two-stage hydroconversion process such as that described in EP-A-0583836 (see above). In the latter case, preferred features of the hydroconversion process may be as disclosed at pages 4 to 6, and in the examples, of EP-A-0583836.

Suitably, a Fischer-Tropsch derived fuel component used in the present invention is a product prepared by a low temperature Fischer-Tropsch process, by which is meant a process operated at a temperature of 250° C. or lower, such as from 125 to 250° C. or from 175 to 250° C., as opposed to a high temperature Fischer-Tropsch process which might typically be operated at a temperature of from 300 to 350° C.

Suitably, in accordance with the present invention, a Fischer-Tropsch derived fuel component will consist of at least 70% w/w, preferably at least 80% w/w, more preferably at least 90 or 95 or 98% w/w, most preferably at least 99 or 99.5 or even 99.8% w/w, of paraffinic components, preferably iso- and normal paraffins. The weight ratio of iso-paraffins to normal paraffins will suitably be greater than 0.3 and may be up to 12; suitably it is from 2 to 6. The actual value for this ratio will be determined, in part, by the hydroconversion process used to prepare the gas oil from the Fischer-Tropsch synthesis product.

The olefin content of the Fischer-Tropsch derived fuel component is suitably 0.5% w/w or lower. Its aromatics content is suitably 0.5% w/w or lower.

According to the present invention, a mixture of two or more Fischer-Tropsch derived fuel components may be used in the fuel composition.

The concentration of the Fischer-Tropsch derived fuel component used will depend on the natures of the other components (including the static dissipator additive) present in the fuel composition in question, and also on the desired target conductivity. In general, the concentration c of the Fischer-Tropsch fuel in the resultant mixture will be higher than the concentration c' which would be possible if linear blending rules applied, wherein c' would be defined by the equation:

$$X=A+c'(B-A)/100,$$

where X is the desired target electrical conductivity for the product fuel composition, A is the electrical conductivity of the composition prior to incorporation of the Fischer-Tropsch derived fuel component (i.e. including the static dissipator additive) and B is the electrical conductivity of the Fischer-Tropsch derived fuel component.

Thus, according to another embodiment of the present invention there is provided a method for adjusting (typically increasing) the electrical conductivity of a fuel composition which contains a static dissipator additive, in order to reach a target level of conductivity X, which method comprises adding to the composition a Fischer-Tropsch derived fuel component, the electrical conductivity B of the Fischer-Tropsch component being lower than the electrical conductivity A of the fuel composition prior to addition of the Fischer-Tropsch component, wherein the concentration c of the Fischer-Tropsch derived component is greater than the concentration c' of the Fischer-Tropsch component which, if linear blending rules applied, could be added to the fuel composition whilst still achieving the target level of conductivity X.

"Achieving" a target conductivity X embraces reaching or exceeding conductivity X.

The (typically volumetric) concentrations c and c' must each have a value between 0 and 100%. When carrying out the method of the present invention the actual concentration of the Fischer-Tropsch fuel, c, is preferably at least 1% v/v higher than the "linear" concentration c', more preferably at least 2 or 5% v/v higher, most preferably at least 10% v/v higher than c'.

In accordance with the present invention, the Fischer-Tropsch derived fuel component may be used in the fuel composition at a concentration of up to 70% v/v. Its concentration may for example be 0.5 or 1% v/v or greater, preferably 2 or 5% v/v or greater. It may be up to 60% v/v, or up to 50 or 40 or 30% v/v. Preferably its concentration is from 1 to 50% v/v, more preferably from 1 to 40% v/v, yet more preferably from 2 to 40 or 30% v/v, most preferably from 5 to 30% v/v.

The Fischer-Tropsch fuel is preferably used at a concentration, between 0 and 100% v/v based on the resultant fuel composition, at which the electrical conductivity of the composition reaches a maximum. This maximum may appear at a different concentration for different Fischer-Tropsch fuels and/or base fuels and/or static dissipator additives. The concentration at which the Fischer-Tropsch fuel is used is preferably chosen so as to achieve a higher conductivity than that of the fuel composition prior to incorporation of the Fischer-Tropsch fuel.

When carrying out the present invention, the Fischer-Tropsch component may be used in the fuel composition for one or more other purposes in addition to the desire to achieve a target conductivity or level of static dissipator additive, for instance to reduce life cycle greenhouse gas emissions. In such cases it may be sufficient, for the purposes of the present invention, that the electrical conductivity of the resultant fuel composition be no lower than, or not substantially lower than, the conductivity of the composition before addition of the Fischer-Tropsch fuel; in other words the conductivity of the composition is maintained alongside the other purposes achieved by addition of the Fischer-Tropsch fuel.

In this context "maintenance" of the electrical conductivity may mean that the conductivity of the composition is no more than 10% lower than, preferably no more than 5% or 2% or even 1% lower than, prior to addition of the Fischer-Tropsch fuel.

The present invention therefore also embraces the use of a Fischer-Tropsch derived fuel component in a fuel composition for two or more simultaneous purposes, one of which is to maintain the conductivity of the composition above a desired target level. This target level may be the level exhibited by the composition prior to addition of the Fischer-Tropsch fuel, or it may be a level (typically 50 pS/m or greater, preferably 80 or 100 pS/m or greater) considered to be desirable for instance for safety reasons.

As described above, when a Fischer-Tropsch derived fuel component is used in a fuel composition containing a static dissipator additive, it appears in some cases to cause its maximum conductivity boost at a particular optimum concentration. Its effect at that concentration can lead to a conductivity above that of the composition prior to addition of the Fischer-Tropsch fuel. In other words, the change in conductivity as a function of increasing concentration of Fischer-Tropsch derived fuel is not linear, but reaches at least one maximum at a Fischer-Tropsch fuel concentration $c_{opt}$ somewhere between 0 and 100%. At and around this point, a greater amount of the Fischer-Tropsch fuel may be added than linear blending rules would predict were possible without, or with less of, a detrimental effect on electrical conductivity.

According to the present invention, the Fischer-Tropsch derived fuel component is preferably added at a concentration (based on the resultant overall fuel composition) equal to $c_{opt}$ or within 5% v/v, more preferably within 2 or 1% v/v, of $c_{opt}$.

There may be more than one optimum concentration for the Fischer-Tropsch fuel component—in other words, the change in conductivity with Fischer-Tropsch fuel concentration may exhibit more than one maximum. In such cases, the concentration of Fischer-Tropsch fuel used may be at, or within the specified proximity to, any of the optimum values.

In accordance with the invention, any static dissipator additive may be used in the fuel composition. A static dissipator additive may for example contain one or more active ingredients selected from organic acids, in particular (benzene) sulphonic acids; amines, in particular polyamines; sulphones, in particular polysulphones; and other hydrocarbon-soluble (co)polymers such as vinyl (co)polymers, in particular those containing cationic monomer units.

Commercially available static dissipator additives include Stadis™ 450 and Stadis™ 425 (both ex. Innospec) and Tolad™ 3514 (ex. Baker-Petrolite). Stadis™ 450, for example, contains dinonylnaphthyl sulphonic acid as an active ingredient; it is typically used in certain distillate fuels, solvents, commercial jet fuels and certain military fuels. Stadis™ 425 contains similar active(s) to Stadis™ 450 and is typically used in distillate fuels and solvents. Tolad™ 3514 contains a hydrocarbon-soluble copolymer of an alkylvinyl monomer and a cationic vinyl monomer.

The concentration of the static dissipator additive in a fuel composition prepared according to the present invention may be for example from 1 to 3 mg/kg. It may be up to 4 mg/kg. It may be 0.5 mg/kg or more, preferably 1 or 1.5 mg/kg or more, such as about 2 mg/kg.

The static dissipator additive may be present in the fuel composition, in accordance with the invention, at a concentration which is different to (preferably lower than) its standard treat rate, due to the use of the Fischer-Tropsch derived fuel component. Thus, the present invention may embrace use of a static dissipator additive in a fuel composition, together with a Fischer-Tropsch derived fuel component, which involves incorporating the static dissipator additive at a concentration other than that which would have been necessary or desirable or usual—for instance to achieve a desired target conductivity—had the Fischer-Tropsch derived fuel component not been present in the composition. Such use may involve incorporating the static dissipator additive at a concentration lower than that which would be necessary or desirable or usual in order to impart adequate electrical conductivity to the overall fuel composition (e.g. taking account of any other additives present in the composition).

The electrical conductivity of a fuel composition may be measured in any suitable manner, for instance using the standard test method ASTM D2624 (probe method) or ASTM D4308 (concentric rings method).

In the context of the above embodiments, "increasing" the electrical conductivity of the fuel composition embraces any degree of increase compared to the conductivity of the composition before incorporation of the Fischer-Tropsch derived fuel component. The methods of the present invention may, for example, involve adjusting the conductivity of the composition, by means of the Fischer-Tropsch derived fuel component and/or the static dissipator additive, in order to meet a desired target conductivity.

By using the present invention, the conductivity of the fuel composition is preferably increased by at least 5 pS/m (ASTM D4308), more preferably by at least 8 or 10 or 12 pS/m, most preferably by at least 15 pS/m, as compared to its value prior to incorporation of the Fischer-Tropsch derived fuel component. The conductivity may be increased by at least 1% of its value prior to incorporation of the Fischer-Tropsch derived fuel component, preferably by at least 2 or 5 or 6% of that value, more preferably by at least 10 or 20 or 25% of that value.

In the context of the present invention, "use" of a Fischer-Tropsch derived fuel component in a fuel composition means incorporating the component into the composition, typically as a blend (i.e. a physical mixture) with one or more other fuel components. The Fischer-Tropsch derived component will conveniently be incorporated before the composition is introduced into an engine or other system which is to be run on the composition. Instead or in addition the use of a Fischer-Tropsch derived fuel component may involve running a fuel-consuming system, typically a diesel engine, on a fuel composition containing the component, typically by introducing the composition into a combustion chamber of an engine.

"Use" of a Fischer-Tropsch derived fuel component in the ways described above may also embrace supplying such a component together with instructions for its use in a fuel composition. The Fischer-Tropsch derived fuel component may itself be supplied as part of a formulation suitable for and/or intended for use as a fuel additive, in which case the Fischer-Tropsch derived component may be included in such a formulation for the purpose of influencing its effects on the electrical conductivity of a fuel composition.

According to the present invention, the fuel composition may contain other additives in addition to the static dissipator additive and the Fischer-Tropsch derived fuel component. Many such additives are known and readily available.

The total additive content in the fuel composition may suitably be from 50 to 10000 mg/kg, preferably below 5000 mg/kg.

According to another embodiment of the present invention, there is provided a method for the preparation of a fuel composition, which process involves blending a base fuel with a static dissipator additive and a Fischer-Tropsch derived fuel component, in particular with respect to the electrical conductivity of the resultant fuel composition.

The method of another embodiment of the present invention may form part of a process for, or be implemented using a system for, controlling the blending of a fuel composition, for example in a refinery. Such a system will typically include means for introducing a base fuel, a static dissipator additive and a Fischer-Tropsch derived fuel component into a blending chamber, flow control means for independently controlling the flow rates of the three components into the chamber, means for calculating the concentrations of the static dissipator additive and/or the Fischer-Tropsch derived fuel component needed to achieve a desired target electrical conductivity input by a user into the system and means for directing the result of that calculation to the flow control means which is then operable to achieve the desired concentrations in the product composition by altering the flow rates of its constituents into the blending chamber.

In order to calculate the required concentrations, a process or system of this type will suitably make use of known conductivities for the base fuel, static dissipator additive and Fischer-Tropsch derived fuel component concerned, and conveniently also a model predicting the conductivity of varying concentration blends of the three according to linear blending rules. The process or system may then, according to the present invention, select and produce a concentration of static dissipator additive lower than that predicted by the linear blending model to be necessary, and/or a Fischer-Tropsch derived fuel concentration higher than that predicted by the linear blending model to be possible.

The present invention may thus conveniently be used to automate, at least partially, the formulation of a fuel composition, preferably providing real-time control over the relative proportions of the base fuel, the static dissipator additive and the Fischer-Tropsch derived fuel component incorporated into the composition, for instance by controlling the relative flow rates or flow durations for the constituents.

Another embodiment of the present invention provides a method of operating a fuel consuming system, which method involves introducing into the system a fuel composition prepared in accordance with the above. Again the fuel composition is preferably introduced for one or more of the purposes described above in connection with the above embodiments of the present invention, in particular to improve the conductivity of the fuel composition and/or to improve the safety of the system and/or its users.

In the present context, a "fuel consuming system" includes a system which transports (for example by pumping) or stores a fuel composition, as well as a system which runs on (and hence combusts) a fuel composition.

The system may in particular be an engine, such as an automotive or aeroplane engine, in which case the method may involve introducing the fuel composition into a combustion chamber of the engine. It may be an internal combustion engine, and/or a vehicle which is driven by an internal combustion engine. The engine is preferably a compression ignition (diesel) engine. Such a diesel engine may be of the direct injection type, for example of the rotary pump, in-line pump, unit pump, electronic unit injector or common rail type, or of the indirect injection type. It may be a heavy or a light duty diesel engine.

Throughout the description and claims of this specification, the words "comprise" and "contain" and variations of the words, for example "comprising" and "comprises", mean "including but not limited to", and are not intended to (and do not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Other features of the present invention will become apparent from the following examples. Generally speaking, the present invention extends to any novel one, or any novel combination, of the features disclosed in this specification (including any accompanying claims). Thus, features, integers, characteristics, compounds, chemical moieties or groups described in conjunction with a particular embodiment or example of the present invention are to be understood to be applicable to any other embodiment or example described herein unless incompatible therewith.

Moreover unless stated otherwise, any feature disclosed herein may be replaced by an alternative feature serving the same or a similar purpose.

The following examples illustrate the properties of fuel compositions prepared in accordance with the present invention, and assess the effects of a Fischer-Tropsch derived gas oil on the electrical conductivity of diesel fuel compositions.

EXAMPLE 1

A UK-sourced, additive-free zero-sulphur automotive diesel fuel was blended with various amounts of (a) a commercially available static dissipator additive Stadis™ 450 (ex. Innospec) and (b) a Fischer-Tropsch derived gas oil.

The zero-sulphur diesel (ZSD) fuel and the Fischer-Tropsch derived (F-T) gas oil had the properties listed in Table 1 below.

TABLE 1

| Fuel property | Test method | ZSD fuel | F-T gas oil |
|---|---|---|---|
| Density @ 15° C. ($g/cm^3$) | IP 365/ ASTM D4052 | 0.8312 | 0.7852 |
| Kinematic viscosity @ 40° C. ($mm^2/s$) | IP 71/ ASTM D445 | 3.013 | 3.606 |
| Distillation (° C.): | IP 123/ ASTM D86 | | |
| IBP | | 166.5 | 211.5 |
| 10% recovered | | 216.9 | 249.0 |
| 20% | | 241.1 | 262.0 |
| 30% | | 258 | 274.0 |
| 40% | | 270.4 | 286.0 |
| 50% | | 280.8 | 298.0 |
| 60% | | 290.5 | 307.5 |
| 70% | | 300.5 | 317.0 |
| 80% | | 311.9 | 326.5 |
| 90% | | 326.7 | 339.0 |
| 95% | | 338.9 | 349.0 |
| FBP | | 350.2 | 354.5 |
| Rec. at 240° C. (% vol) | | 19.4 | 5.5 |
| Rec. at 250° C. (% vol) | | 24.8 | 10.5 |

TABLE 1-continued

| Fuel property | Test method | ZSD fuel | F-T gas oil |
|---|---|---|---|
| Rec. at 340° C. (% vol) | | 95.3 | 90.5 |
| Rec. at 345° C. (% vol) | | 96.8 | 93.5 |
| Rec. at 350° C. (% vol) | | 97.9 | 95.0 |
| Sulphur content (mg/kg) | ASTM D2622 | 8 | <5 |
| Aromatics (% m) | IP 391 (mod) | | |
| Mono | | 17.7 | 0.1 |
| Di | | 2.5 | <0.1 |
| Tri | | 0.3 | <0.1 |
| Total | | 20.5 | 0.1 |

The blends were homogenised by mechanical shaking for three hours. The electrical conductivity of each blend was then measured using the standard test method ASTM D4308 (concentric rings method). Conductivities were measured again after leaving the blends to stand for 43.5 hours. The results are shown in Table 2 below.

TABLE 2

| Stadis ™ 450 (mg/kg) | ZSD (% v/v) | F-T gas oil (% v/v) | Conductivity (pS/m) Before standing | Conductivity (pS/m) After standing |
|---|---|---|---|---|
| 2 | 100 | 0 | 235 | 227 |
| 2 | 90 | 10 | 250 | 241 |
| 2 | 70 | 30 | 233 | 216 |
| 2 | 50 | 50 | 208 | 200 |
| 2 | 0 | 100 | 158 | 150 |
| 5 | 100 | 0 | 538 | 515 |
| 5 | 90 | 10 | 535 | 513 |
| 5 | 70 | 30 | 520 | 497 |
| 5 | 50 | 50 | 451 | 431 |
| 5 | 0 | 100 | 374 | 358 |

(The conductivities of blends containing only the ZSD fuel and/or the Fischer-Tropsch derived fuel, i.e. prior to addition of the static dissipator additive, were also checked using the standard test method ASTM D2624 (probe method), and were found, as expected, to be nearly 0 pS/m.)

The data for blends containing 2 mg/kg of the static dissipator additive show that, despite its almost negligible inherent conductivity, incorporation of the Fischer-Tropsch derived fuel can result—at least at lower concentrations—in an increase in conductivity of the diesel fuel/static dissipator additive blend. At Fischer-Tropsch fuel concentrations of up to 50% v/v, the electrical conductivities of the blends are also higher than would be predicted using linear interpolation (i.e. by assuming a linear relationship between conductivity and Fischer-Tropsch fuel concentration). This effect appears to reach a maximum at around 10% v/v of the Fischer-Tropsch fuel.

Similarly, using 5 mg/kg of the static dissipator additive, the conductivities of the blends containing the Fischer-Tropsch fuel are higher than would be predicted using linear interpolation. In other words, the change in conductivity with Fischer-Tropsch fuel concentration is non-linear. However, in this case there does not appear to be a maximum in the conductivity boosting effect.

At both concentrations of static dissipator additive, the same trend is observed in the conductivities of the fuel blends after standing.

Thus, if one is aiming for a target conductivity in the overall blend, it is possible to include a higher concentration of the Fischer-Tropsch derived fuel than would have been predicted by linear interpolation to be possible. For example, if the target conductivity is 235 pS/m, which (at 2 mg/kg of Stadis™ 450) linear interpolation would predict to be possible only using 100% of the zero sulphur diesel fuel, then in accordance with the present invention it is possible to include up to about 30% v/v of a Fischer-Tropsch derived fuel component without significant reduction in conductivity, yet with associated advantages in terms for instance of reduced emissions.

Alternatively, it is possible in accordance with the present invention to use lower concentrations of the often costly static dissipator additive, without reduction in conductivity, by the supplementary addition of a Fischer-Tropsch derived fuel. For example, the amount of static dissipator additive needed to achieve a target conductivity of 249.5 pS/m in the zero sulphur diesel alone can be calculated—from previous experiments on the fuel—to be 2.5 mg/kg. If, however, 10% v/v of the zero sulphur diesel is replaced with the Fischer-Tropsch derived fuel, Table 2 shows that only 2 mg/kg of the static dissipator additive is needed to achieve the target conductivity—a 20% reduction in the amount (and hence the likely cost) of the additive.

In situations where levels of static dissipator additive have been predetermined, for instance due to additive introduction at the refinery, a Fischer-Tropsch derived fuel may nevertheless be used, in accordance with the present invention, to yield an overall improvement in conductivity and hence safer fuel handling properties.

The present invention is likely to be of particular use for fuel compositions having an inherently low electrical conductivity, for example those containing low levels of sulphur and/or other polar species.

EXAMPLE 2

The two fuels used in Example 1 were each individually blended with various concentrations (0.5, 1, 2 and 5 mg/kg) of Stadis™ 450. The conductivity of each blend was measured using ASTM D2624 and the results plotted graphically.

It was established from these experiments that the static dissipator additive was less effective in the Fischer-Tropsch derived fuel than in the conventional (petroleum derived) diesel fuel. The relationship between conductivity (C) and concentration (S) of static dissipator additive was calculated in the case of the zero sulphur diesel fuel to be best represented by the linear equation:

$$C=(94.013\times S)+15.278,$$

whereas the corresponding equation in the case of the Fischer-Tropsch fuel was:

$$C=(67.446\times S)+6.4415.$$

Generally speaking, the conductivity of a fuel will increase linearly with increasing concentration of static dissipator additive. However, the gradient of this line is more shallow for the Fischer-Tropsch derived fuel than it is for the non-Fischer-Tropsch derived zero-sulphur diesel fuel. This makes it particularly surprising that—as shown in Example 1—the Fischer-Tropsch derived fuel is able to boost the conductivity of a fuel composition containing a static dissipator additive.

What is claimed is:

1. A method for formulating a fuel composition, which method comprises adding to a non-Fischer-Tropsch derived base fuel, from 0.5 to 5 mg/kg of a static dissipator additive which contains one or more active ingredients selected from the group consisting of sulphonic acids, polyamines, sulphones, and vinyl polymers, and an amount of Fischer-Tropsch derived fuel component having an electrical conductivity lower than that of the base fuel and static dissipator additive together, where the amount of Fischer-Tropsch derived fuel component is greater than the concentration c', wherein c' is defined by the equation:

$$X = A + c'(B - A)/100$$

Wherein X is the target electrical conductivity for the product fuel composition, A is the electrical conductivity of the composition prior to incorporation of the Fischer-Tropsch derived fuel component and B is the electrical conductivity of the Fischer-Tropsch derived fuel component.

2. A method of operating a fuel consuming system, which method comprising introducing into the system a fuel composition prepared by the method of claim 1.

3. The method of claim 1 wherein the fuel composition is an automotive diesel fuel composition.

4. The method of claim 1 wherein the Fischer-Tropsch derived fuel component is used in the fuel composition at a concentration of from 1 to 50% v/v.

5. The method of claim 1 wherein the static dissipator additive contains as active ingredients a sulphonic acid or a hydrocarbon-soluble copolymer of an alkylvinyl monomer and a cationic vinyl monomer.

6. The method of claim 1 wherein the static dissipator additive contains as active ingredients a sulphonic acid or a hydrocarbon-soluble copolymer of an alkylvinyl monomer and a cationic vinyl monomer.

7. The method of claim 6 wherein the Fischer-Tropsch derived fuel component is used in the fuel composition at a concentration of from 1 to 50% v/v.

* * * * *